US008607717B2

(12) United States Patent
Einarsson

(10) Patent No.: US 8,607,717 B2
(45) Date of Patent: Dec. 17, 2013

(54) BATCH WASTE GASIFICATION PROCESS

(75) Inventor: Fridfinnur Einarsson, Reykjanesbaer (IS)

(73) Assignee: WTE Waste To Energy Canada, Inc., Vancouver (CA)

( * ) Notice: Subject to any disclaimer, the term of this patent is extended or adjusted under 35 U.S.C. 154(b) by 1139 days.

(21) Appl. No.: 12/517,997

(22) PCT Filed: Dec. 7, 2007

(86) PCT No.: PCT/IS2007/000022

§ 371 (c)(1),
(2), (4) Date: Aug. 4, 2009

(87) PCT Pub. No.: WO2008/068781

PCT Pub. Date: Jun. 12, 2008

(65) Prior Publication Data

US 2010/0199895 A1 Aug. 12, 2010

(30) Foreign Application Priority Data

Dec. 7, 2006 (IS) ..... 8577

(51) Int. Cl.

| | |
|---|---|
| ***F23N 5/18*** | (2006.01) |
| ***F23B 10/02*** | (2011.01) |
| ***F23G 5/16*** | (2006.01) |

(52) U.S. Cl.

USPC ..... 110/188; 110/210; 110/248; 110/296; 110/297; 110/346; 110/348

(58) Field of Classification Search

USPC ..... 110/188, 190, 210, 235, 248, 295, 296, 110/312, 346, 229, 230, 348; 48/102 A, 113

See application file for complete search history.

(56) References Cited

U.S. PATENT DOCUMENTS

| | | | | | |
|---|---|---|---|---|---|
| 4,362,269 | A | * | 12/1982 | Rastogi et al. | 236/14 |
| 4,385,567 | A | * | 5/1983 | Voss | 110/186 |
| 4,648,329 | A | * | 3/1987 | Couarc'h et al. | 110/245 |
| 4,870,910 | A | | 10/1989 | Wright et al. | |
| 5,261,337 | A | * | 11/1993 | Orita et al. | 110/346 |
| 5,606,924 | A | * | 3/1997 | Martin et al. | 110/341 |
| 5,694,868 | A | * | 12/1997 | Mitthof | 110/210 |
| 5,941,184 | A | * | 8/1999 | Casacia et al. | 110/346 |
| 6,138,587 | A | * | 10/2000 | Christmann et al. | 110/346 |
| 6,192,739 | B1 | * | 2/2001 | Logue et al. | 73/24.01 |
| 6,336,415 | B1 | * | 1/2002 | Ruegg et al. | 110/342 |
| 7,975,628 | B2 | * | 7/2011 | Martin et al. | 110/346 |

* cited by examiner

*Primary Examiner* — Kenneth Rinehart
*Assistant Examiner* — David J Laux
(74) *Attorney, Agent, or Firm* — Muncy, Geissler, Olds & Lowe, PLLC

(57) ABSTRACT

The present invention relates to a regulated two stage thermal oxidation of waste and applications to use such a process for energy generation. A system and a method are provided comprising a set up of one or more gasification chambers, which are connected via ductwork to a combustion chamber to burn the waste material. The waste is loaded into the gasification chamber(s) and ignited there and the gas, which is generated by the sub-stoichiometric combustion in the gasification chamber is fully combusted in the secondary combustion chamber at a very high temperature. The time used for the burn down period is decreased and controlled by several air and gas flow factors of the system of the present invention.

16 Claims, 1 Drawing Sheet

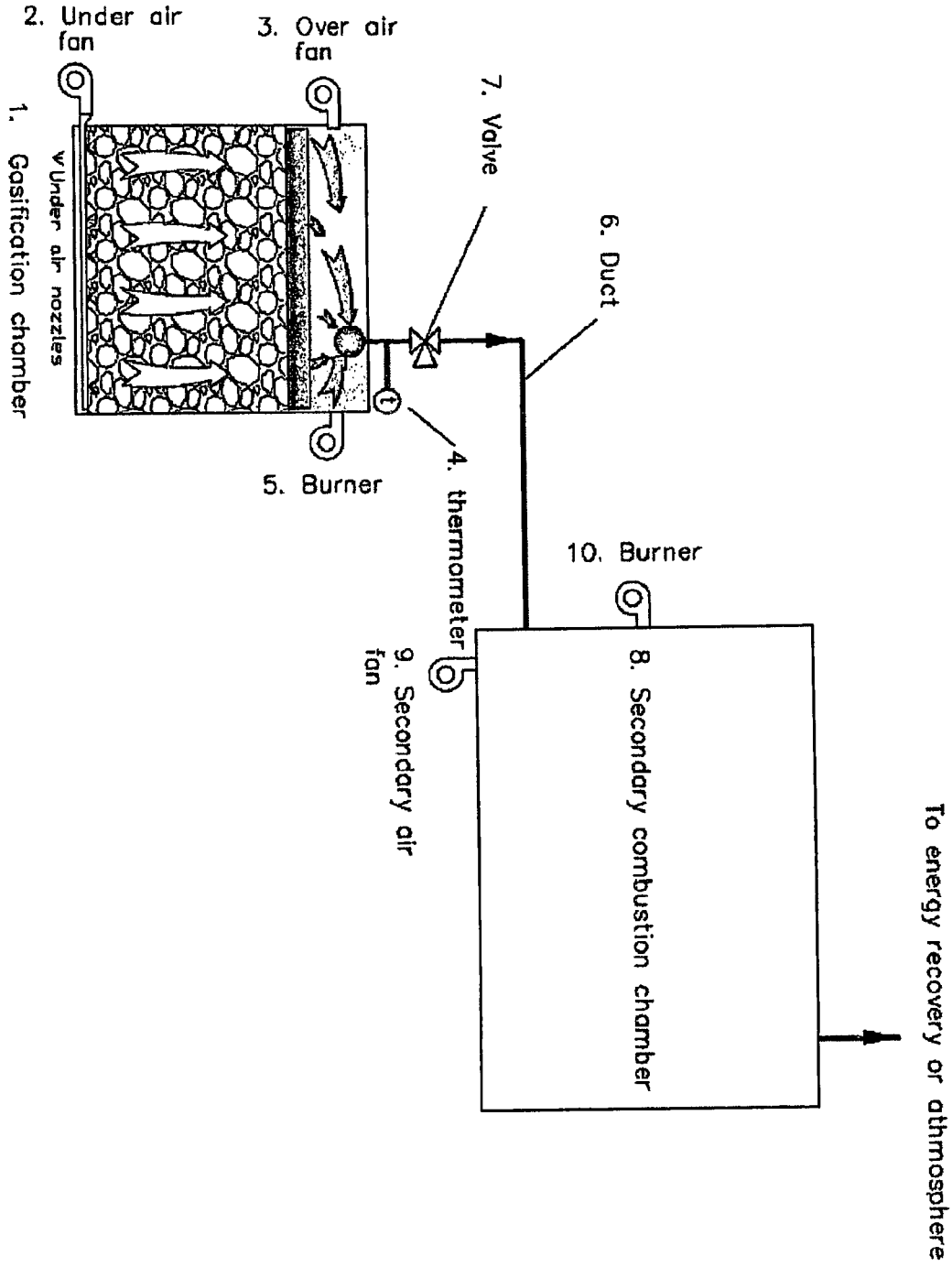
To energy recovery or athmosphere
8. Secondary combustion chamber
10. Burner
9. Secondary air fan
4. thermometer
6. Duct
7. Valve
5. Burner
t
1. Gasification chamber
v Under air nozzles
2. Under air fan
3. Over air fan

BATCH WASTE GASIFICATION PROCESS

FIELD OF THE INVENTION

The present invention relates to a regulated two stage thermal oxidation of waste and applications to use such a process for energy generation.

BACKGROUND OF THE INVENTION

It is well known in the art to use a two stage combustion process is to burn combustible waste materials under substoichiometric conditions. In this kind of process burn down takes place in a first chamber resulting in combustible gases and ash, where the gases are further mixed with air and burned under superstoichiometric conditions in the second chamber.

U.S. Pat. No. 5,941,184 discloses a controlled thermal oxidation process for solid combustible waste comprising a first combustion stage, wherein the waste is burned in a downward direction from top to bottom. The burn down in the combustion stage is supported by a fixed air flow of predetermined volume which is passed from bottom to top of the waste and a modulated air flow of predetermined lesser volume which is passed over the waste and through the combustion flame. The second combustion stage of this process includes combustion of the products from the first stage by exposing them to high temperature conditions for a short period of time under stoichiometric air conditions.

SUMMARY OF THE INVENTION

A system and a method are provided for oxidation of waste materials. A set up of one or more gasification chambers, which are connected via ductwork to a combustion chamber, are used to burn the waste material. The waste is loaded into the gasification chamber(s) and ignited there and the gis, which is generated by the sub-stoichiometric combustion in the gasification chamber is fully combusted in the secondary combustion chamber at a very high temperature.

In a first aspect the present invention relates to a process for thermal oxidation of waste materials. First a burn down step takes place in a first chamber, where waste is burned down by providing a first stream of air flow from the bottom of chamber, where the air flow enters from the bottom of the chamber and is directed underneath and through the waste. A second stream of air flow is then provided from the top of the first chamber. Thereafter, a combustion step takes place in a second chamber, where products (gases) from the burn down step in the first chamber are exposed to high temperature and an air flow is provided to the second chamber.

In a second aspect of the present invention a method is provided for thermal oxidation of waste, the method comprising the steps of:

burning down waste in a first chamber by providing a first stream of air flow, coming through an inlet at the bottom of the chamber, and guided from the underneath and through the waste and a second stream of air flow is provided from the top of the first chamber, and exposing gas from the first chamber to a high temperature in a second chamber, for a predetermined minimum time period and providing an additional air flow is provided to the second chamber.

The new and improved system and method are characterized by the control of the burn down step. Firstly, the combustion step in the second chamber is carried out for a predetermined time period. This predetermined time period is in one embodiment a minimum time period. Secondly, the ratio between the air flow from the top and the bottom of the first chamber is modified by increasing the air flow from the bottom of the chamber when the temperature falls in the chamber and when the temperature rises the airflow from the bottom of the chamber is decreased and the air flow from the top of the chamber is increased respectively. Furthermore, the system and the method are also characterized in that the volume of gas from the first chamber flowing into the second chamber regulates the additional air flow into the second chamber to facilitate the burn at high temperature in the second chamber.

In a third aspect of the present invention, an apparatus for thermal oxidation of waste is provided. The apparatus comprises a first chamber for burning down waste, further comprising a first air inlet at the bottom of the first chamber and a second air inlet at the top of the first chamber. The first chamber also has one or ore means for transporting air to the air inlets at the top and bottom of the first chamber, a thermometer for monitoring the temperature in the first chamber and one or more burners for igniting the burn down phase. The apparatus further comprises a second chamber for combustion of gas from the first chamber, having a gas inlet for the gas from the first chamber, a secondary air inlet, a second burner and an outlet for disposing of gas from the combustion of the gas. The first and the second chambers are connected by a duct, which further comprises a valve to control the flow of gas between the first and the second chamber. An industrial computer is also provided for regulating the flow of air transported into the first and the second chambers as well as the time period of the combustion step in the second chamber. In an embodiment of the present invention the first chamber of the apparatus is a gasification chamber and the second chamber is a combustion chamber. In another embodiment two or more gasification chambers are connected to the combustion chamber via ducts. Further embodiments relate to use the heat from the combustion chamber(s) to heat other media, such as water, for use in heating houses for example. Then a heat exchanger is connected to the combustion chamber.

In one embodiment of the present invention the flow of gas/air exiting the second chamber determines the speed of air flow from the bottom inlet in the first chamber. This means that if the flow of air through the air flow at the bottom of the first chamber is increased if the speed of air/gas flow from the second chamber decreases. If, however, the speed of air/gas flow from the second chamber increases the flow of air through the air flow at the bottom of the first chamber is decreased. The overall management of the system of the present invention is controlled through a control computer, such as an industrial computer. The computer receives input data such as flow of gas from the first chamber to the second chamber and flow of gas from the second chamber, as well as temperature in the chambers. The control computer regulates, manually or through predetermined programs, air inlets into both chambers as well as burners and valves. If the system and the method are set up to work with an energy recovery system, the industrial computer will also regulate ignition in different gasification chambers in order to maintain constant flow of hot gases from the combustion chamber.

BRIEF DESCRIPTION OF THE DRAWING

FIG. 1 is a schematic of the invention showing components of a system for batch waste gasification.

DETAILED DESCRIPTION OF THE INVENTION

The following embodiments disclose systems having one or more gasification chambers connected via ductwork to a secondary combustion chamber. The waste material is loaded into the gasification chamber(s) and ignited there. The gas generated by the sub-stoichlometric combustion in the gasification chamber is fully combusted in the combustion chamber. The flow of hot gases can be used for several types of energy recovery systems.

The System of the Invention

The components of the system are schematically shown in FIG. 1 with reference numbers indicating the specific components of the system.

The first chamber (1), which is the gasification chamber, is equipped with two variable air flow inlet/sources to introduce air to the process. The first inlet (2) blows air under the waste (an under air fan) and the second inlet (3) blows air over the waste (an over air fan). The first chamber further comprises a thermometer (4) to monitor the temperature in the chamber or the temperature of the gas flowing from the chamber. The first chamber is also equipped with one or more burners (5). Each gasification chamber is equipped with a duct (6) connecting the chamber to the second chamber, which is the combustion chamber. This duct has a valve (7) to close the connected ductwork between the gasification chamber(s) and the combustion chamber. The second chamber (8) is further equipped with a variable combustion air inlet/source (9), with an even distribution on the side of gasification gas entry. The secondary combustion chamber is also equipped with one or more auxiliary fuel burners (10). The system is controlled by an induttrial computer, which is connected to thermometers and air inlets of the device.

Operation of the System of the Invention

Loading method for the system of the present invention is dependent on the system capacity as well as the size of the first chamber. Loading systems can be select from a front end loader or a telescopic handler, hand loading or conveyor loading. After loading the waste into the first chamber it is closed and sealed tight.

The waste material is loaded into a first chamber (gasification chamber) and a flame from an auxiliary burner is ignited to operate for a short period of time. The burners operate until the temperature in the first chamber reaches the burners upper temperature set-point. Once this temperature is achieved, the burner in the primary chamber shuts off automatically. Instruments monitor and control the chamber temperature by controlling the air flow to the combustion bed. Under most conditions the burner in the primary chamber runs for less than 15 minutes each batch and has therefore very low fuel consumption.

The rate of volumetric air flow of the first and the second air inlet are measured and varied by the controls. The thermometer in the first chamber detects the temperature in the chamber and that temperature is reported to the control computer. Each operation is performed according to a predefined program, which defines the time for each step of the process. If the temperature in the first chamber drops below the desired limit, the air flow from the lower inlet is increased. If the If the temperature in the first chamber elevates above the desired limit, the air flow from the upper inlet is increased. When the air flow in the upper inlet is increased, the air flow from the lower inlet is decreased respectively and vice versa. This means that if maxim (100%) amount of air is being pumped in to the chamber from the lower inlet, no air is being pumped in from the upper inlet. If 80% of maximum is being pumped into the chamber from the upper inlet, 20% of maximum air is being pumped in from the lower inlet.

The burner(s) in the second chamber (combustion chamber) are used for preheating the chamber and to maintain a settable minimum temperature. The control features for the burner(s) start the burner(s) at a lower temperature set point and stop the burner(s) at a higher temperature set point. The secondary combustion air inlet to the combustion chamber is controlled in accordance to a single temperature set point aiming to maintain even set temperature. As the temperature in the secondary chamber rises above the set point the controls increase the flow of secondary combustion air and vice versa. The flow rate of the secondary air flow is indicated to the controls. This value is used for control of under air flow during some of the operation stages of the gasification chambers. The controls of the secondary combustion air flow have a minimum flow setting which is enabled if one or more chambers are in either ignition or gasification mode as defined below.

The operation of the process in the combustion chamber is based on several components and criteria. The temperature for burning all gases and chemicals generated in the gasification chamber is preset, such as 890° C. The relationship between the burned gas entering from the gasification chamber and the air flow from the secondary combustion air inlet as well as the volume of gases leaving the combustion chamber regulates the operation in the combustion chamber. When a certain volume of gases are introduced into the combustion chamber from the gasification chamber, a predetermined volume of air flow through the secondary combustion air inlet is required to maintain burning of gases in the combustion chamber. This relationship between incoming gases and air flow must be highly regulated, so that the temperature in the combustion chamber is maintained at the desired/predetermined temperature. The volume of gases leaving the combustion chamber, after being burned therein, determines how much air is introduced into the chamber through the secondary combustion air inlet.

Control of the System of the Invention

The process in the gasification chambers is controlled in accordance to predefined modes by the controlling computer. The flow of air of both under and over air inlets for the gasification chambers and burners are controlled by different methods depending on which mode the process is in at any given time. The lower air inlet is controlled by PID (Proportional, Integral and Differential) control, which has different control values for each mode of the operation. The process is divided into Ignition mode, gasification mode, excess air mode, cooling mode and off mode.

Ignition Mode Controls

- During the ignition mode the burner(s) operate in accordance to a lower temperature set point for start and a higher temperature set point to stop.
- The upper air inlet is not used during this mode.
- For control of the under air source a target value for the volumetric flow rate of the secondary combustion air source is set. The volumetric flow rate of the under air source is variable and is controlled in accordance to indication of the volumetric flow rate of the secondary combustion air source. If the secondary combustion volumetric air flow is below the target value, the under air volumetric flow rate is increased in order to increase the gasification rate and therefore the rate of the secondary air volumetric flow rate and vice versa.
- During the ignition mode a settable maximum flow rate for the volumetric flow rate of the under air is active.
- The ignition mode is active for a settable time length counting from the start of ignition. After this time has elapsed the chamber goes into gasification mode.

Gasification Mode Controls

During the gasification mode the burner(s) operate in accordance to a lower temperature set point for start and a higher temperature set point to stop.

The upper air inlet is not used during this mode.

For control of the under air source a target value for the volumetric flow rate of the secondary combustion air source is set. The volumetric flow rate of the under air source is variable and is controlled in accordance to indication of the volumetric flow rate of the secondary combustion air source. If the secondary combustion volumetric air flow is below the target value, the under air volumetric flow rate is increased in order to increase the gasification rate and therefore the rate of the secondary air volumetric flow rate and vice versa.

When the exit gas from the gasification chamber reaches a settable temperature the chamber goes into next mode.

Excess Air Mode Controls

During the excess air mode the burner(s) do not operate.

During this mode the volumetric flow rate of the under air is controlled in accordance to the exit temperature of the gases from the gasification chambers. The target value of the exit temperature is settable. When the temperature of the exiting gases increases above the set point the under air volumetric flow rate is decreased and vice versa.

Over air volumetric rate is controlled directly dependent on the under air flow rate in a reverse relation. In other words when the under air flow is at maximum over air flow is at minimum and vice versa. These maximum and minimum air flows (fan speeds) are settable for both under air and over air. The span between the minimum and maximum are scaled in the control system such that when the under air is at the maximum set value the over air will return the minimum set value, and therefore when the under air is at mid way between its minimum and maximum setting the over air will return a flow which is mid way between the minimum and maximum of the over air settings. As an example the minimum speed of the under air fan might be set at a minimum speed of 20 Hz and maximum of 60 Hz, at the same time the over air fan might be set at minimum speed 0 Hz and maximum 60 Hz. When the controls run the under air to minimum (20 Hz) to reduce temperature of the gas from the gasification chamber then the over air fan would be running at 60 Hz (its maximum). Using the same min/max settings, if the under air flow is maintaining the temperature of gas flow from the gasification chamber at it's set value by running mid way between the minimum and maximum values i.e. 40 Hz the control system would return a value mid way between the minimum and maximum setting of the over air fan i.e. 30 Hz.

When the exit gas from the gasification chamber reaches a settable temperature the chamber goes into next mode.

Cooling Mode Controls

During the cooling mode the burner(s) do not operate.

During this mode the volumetric flow rate of the under air is controlled at a fixed settable value.

During this mode the volumetric flow rate of the over air is controlled at a fixed settable value.

When the exit gas from the gasification chamber reaches a settable temperature the chamber goes into next mode.

Off Mode Controls

During this mode all air sources and burners in the first chamber are shut down.

While the gasification chambers are in any other mode than the off mode, the loading and discharge doors are interlocked closed.

The system can process waste of various quality i.e. various; heat value, moisture content, density and chemical composition. If the overall heat value of the waste is low the speed of the gasification process will be faster for each batch i.e. it will take shorter time to process the particular batch. Higher heat value batches will take longer to process.

As long as one or more gasification chambers are in gasification mode auxiliary fuel is not needed to maintain the secondary combustion temperature given the set temperature is not higher than 1200° C.

Control of Under Air Flow Through the Bottom Inlets in the Gasification Chamber(S)

The under air source volumetric air flow is varied by the control computer during the ignition and gasification modes. This is done in accordance to the volumetric flow out of the secondary combustion chamber. That is, a target value of the volumetric flow rate of hot gases is used as a control signal for the under air source control. As the volumetric flow rate from the secondary combustion chamber is decreased below the target value, the volumetric flow rate of the under air source in the gasification chamber is increased and vice versa.

As an example three different ways for controlling this step are outlined below, which are not limiting for the present invention.

One way of controlling this is that the flow of hot gases from the recovery boiler can be measured by a flow measuring device which generates an analogue signal for the control computer. This signal is then used for controlling the air flow from the under air source.

Another way is to use the flow of hot gases from the secondary combustion chamber, as it is proportional to the flow of air from the secondary chamber air fans. Therefore, the fan speed can be used as an analogue signal for the control computer, which is used for controlling the under air source.

A third way of controlling the air flow from the under air source requires that the batch gasification system is equipped with an energy recovery and emission control equipment and that it will also be equipped with an induced draft fan. The speed of this fan is controlled by the control computer to maintain even negative pressure on the entire system. The speed of this fan will be proportional to the volumetric flow rate from the secondary combustion chamber. Therefore the fan speed can be used as an analogue signal for the control computer.

By controlling the volumetric flow rate of the hot gases from the secondary combustion chamber the energy production in the energy recovery equipment can be varied in accordance to need as long as at least one gasification chamber is in gasification mode.

Enemy Recovery Systems

In an embodiment of the present invention the flow of hot gases is used to generate energy. As the rate of the gasification can be controlled by previously descried methods the flow of hot gases from the secondary combustion chamber are controlled very evenly. Even flow rate of hot gases enables more even recovery of energy such as steam production for turbines or other use.

Regardless of operation methods the secondary combustion chamber always operates the same as per previous description. Depending on the number of gasification chambers connected to a secondary combustion chamber four different operation methods can be selected.

Single Chamber Operation

The single chamber operation is an operation of one first chamber independent of other first chambers that may be connected to the same secondary combustion chamber. The gasification chamber operates in accordance to the description above.

Double Chamber Operation

The double chamber operation method is for two gasification chambers operated at the same time with the aim for both chambers to complete their process at the same time. During this type of operation the chambers operate in accordance to the description above except that when the controls call for to reduce the rate of gasification from the chambers the under air flow on the one chamber that has the higher exit gas temperature reduces it rate of volumetric under air flow. When the controls call for increased rate of gasification the under air flow of the chamber that has a lower exit gas temperature is increased.

Multiple Chamber Operation

The multiple chamber operation is for the operation of multiple gasification chambers all of which are operating at the same target value. When the controls call for reduction in the rate of gasification the under air volumetric flow is reduced to all first chambers that are in the either ignition or gasification mode, and vice versa.

Sequence Chamber Operation

The sequence chamber operation is for operating one gasification chamber after another in order to maintain as even as possible operation over a period of time for example for continuous operation of a waste plant. By this operation method the next gasification chamber goes into ignition mode when the previous one goes into excess air mode. Burners and fans are controlled independently for each chamber depending on the mode each chamber is in.

Burners and air sources in the secondary combustion chamber are automatically shut down when all gasification chambers go into either cooling mode or off mode. As long as one or more gasification chamber is in, ignition, gasification or burn down mode, the burner(s) and air sources in the secondary combustion chamber are controlled in accordance to the description above.

Example of a Typical Gasification Cycle

In order to start ignition in any gasification chamber the secondary combustion chamber has to be up to the minimum operation temperature of 850° C. (for non-halogenated waste or alternatively 1100° C. for halogenated waste). Assuming the system is being started from cold the secondary combustion chamber would be pre-heated while the first gasification chamber would be loaded.

When the gasification chamber has been loaded the operator pushes the start button for the gasification/burn cycle in that chamber. When the pre-heat temperature has been met in the secondary combustion chamber, the controls will open the valve in the duct between the gasification chamber and the secondary combustion chamber. When the valve has been fully opened the ignition burner is started. The burner is active until the temperature of the gases flowing in the duct between the chambers reaches 200° C. After this is obtained, the gasification in the gasification chamber is self-sustaining. Depending on the waste mixture, the ignition mode may be set for a period of, but not limited to 15-60 minutes. The temperature of the gases flowing in the duct may lower to around 150° C. shortly after the burner has been turned off, which does not affect fact that the gasification is still self-sustaining. The speed of the under air fan will be slowly increased as gasification of the batch in the gasification chamber progresses. The temperature of the gas passing from the gasification chamber to the secondary combustion chamber will also slowly increase until it reaches 850° C. At this point the under air fans will be running at high speed commonly between 50-60 Hz. When a temperature of 850° C. has been reached, the control computer changes the program from gasification mode to excess air mode. As a result of this, the over air fan is started, initially at a low speed. If for example the under air fan is at 50 Hz when the controls change mode the speed of the over air fan will start at 10 Hz. When the process has reached this stage, the process in the gasification chamber will change from gasification to excess air combustion. The speed of the under air fan is reduced, while the speed of the over air fan is increased in order to maintain temperature of 850° C. The over air fan will usually reach maximum speed for a short time while the under air fan will stop during the same period of time. After a time period of 30-60 minutes the speed of the under air fan is increased to promote faster release of energy from the remaining waste and at the same time the speed of the over air fan is decreased. At this point the combustion in the gasification chamber is taking place under excess air conditions. The temperature of the gas in the duct between the chambers is maintained throughout the excess air mode, being constant at 850° C. by the controls. This is controlled by varying the speed of the two fans as described above. When the energy of the waste has been consumed in the combustion the under air fan will have reached maximum and over air fan minimum. At this point the temperature of the gases in the duct between the chambers will drop slowly. When the gas temperature has dropped down to 700° C., the controls change mode and the chamber goes into cooling mode. During this mode, the under air fan is run at full speed (60 Hz) and the over air fan at half speed (30 Hz). The fans are run like this until the temperature of the air flowing in the duct between the gasification and secondary combustion chamber drop down to 100° C. When this temperature has been reached the control computer changes the mode to off mode. The operator can then open the chamber and remove the ash and load again.

The invention claimed is:

1. A process for thermal oxidation of waste comprising the steps of:

a burn down step in a first chamber, where waste is burned down by providing a first stream of air flow from a bottom inlet on the first chamber and through the waste and a second stream of air flow is provided from a top inlet on the first chamber, and a combustion step in a second chamber, gas from the first chamber is exposed to high temperature and an air flow is provided to the second chamber, wherein the combustion step in the second chamber is carried out for a predetermined time period, and wherein a flow rate of gas/air exiting the second chamber determines an air flow rate from the bottom inlet in the first chamber, such that the air flow rate from the bottom inlet in the first chamber increases when the flow rate of gas/air exiting the second chamber decreases, and the air flow rate from the bottom inlet in the first chamber decreases when the flow rate of gas/air exiting the second chamber increases.

2. The process according to claim 1, wherein the air flow rates from the top and the bottom of the chamber of the first chamber are independently controlled.

3. The process according to claim 1, wherein the volume of gas from the first chamber flowing into the second chamber regulates the air flow into the second chamber.

4. The process according to claim 3, wherein the ratio between the air flow rates from the top and bottom inlets of the first chamber is modified such that the air flow rate from the bottom inlet is increased when the temperature falls in the chamber and the air flow rate from the top inlet is decreased.

5. The process according to claim 3, wherein the ratio between the air flow rates from the top and bottom inlets of the first chamber is directly proportional.

6. The process according to claim 1, wherein the flow rate of gas/air exiting the second chamber determines the amount of excess air flow into the second chamber.

7. A method for thermal oxidation of waste comprising the steps of:

burning down waste in a first chamber by providing a first stream of air flow from the bottom of the first chamber, through the waste and a second stream of air flow is provided from the top of the first chamber, and exposing gas from the first chamber to a high temperature in a second chamber, and providing an additional air flow is provided to the second chamber, wherein the combustion step in the second chamber is carried out for a predetermined time period, and a flow rate of gas/air exiting the second chamber determines an air flow rate from the bottom inlet in the first chamber, such that the air flow rate from the bottom inlet in the first chamber increases when the flow rate of gas/air exiting the second chamber decreases, and the air flow rate from the bottom inlet in the first chamber decreases when the flow rate of gas/air exiting the second chamber increases.

8. The method according to claim 7, wherein the air flow rates from the top and the bottom of the chamber of the first chamber are independently controlled.

9. The method according to claim 7, wherein the volume of gas from the first chamber flowing into the second chamber regulates the air flow into the second chamber.

10. The method according to claim 9, wherein the ratio between the air flow rates from the top and bottom inlets of the first chamber is modified such that the air flow rate from the bottom inlet is increased when the temperature falls in the chamber and the air flow rate from the top inlet is decreased.

11. The method according to claim 9, wherein the ratio between the air flow rates from the top and bottom inlets of the first chamber is directly proportional.

12. The method according to claim 7, wherein an industrial computer regulates the air flow rate from the bottom inlet in the first chamber, where the air flow rate is determined based on the flow rate of the gas/air exiting the second chamber.

13. An apparatus for thermal oxidation of waste, the apparatus comprising:

a first chamber for burning down waste, the first chamber further comprising:

a first air inlet at the bottom of the first chamber, a second air Inlet at the top of the first chamber, one or more means for transporting air to the air inlets at the top and bottom of the first chamber, a thermometer for monitoring the temperature in the first chamber, one or more burners, a second chamber for combustion of gas from the first chamber, the second chamber further comprising a gas inlet for the gas from the first chamber, a secondary air inlet, a second burner, and an outlet for disposing of gas from the combustion of the gas, a duct connecting the first and the second chambers, the duct further comprising a valve to control the flow of gas between the first and the second chamber, and an industrial computer, wherein the industrial computer regulates an air flow rate from the bottom inlet in the first chamber, where the air flow rate is determined based on a flow rate of gas/air exiting the second chamber, such that the air flow rate from the bottom inlet in the first chamber increases when the flow rate of gas/air exiting the second chamber decreases, and the air flow rate from the bottom inlet in the first chamber decreases when the flow rate of gas/air exiting the second chamber increases.

14. The apparatus according to claim 13, wherein the first chamber is a gasification chamber and the second chamber is a combustion chamber.

15. The apparatus according to claim 13, wherein two or more gasification chambers are connected to the combustion chamber via duets.

16. The apparatus according to claim 13, wherein a heat exchanger is connected to the combustion chamber.

* * * * *